US005967697A

United States Patent [19]

Larsen

[11] Patent Number: 5,967,697

[45] Date of Patent: Oct. 19, 1999

[54] FLOOD CONTROL GATE SAFETY DEVICE

[76] Inventor: Paul Larsen, 2779 SW. 22 Ave., Miami, Fla. 33133

[21] Appl. No.: 08/929,331

[22] Filed: Aug. 30, 1997

[51] Int. Cl.[6] ..... E02B 7/26

[52] U.S. Cl. ..... 405/104; 405/103; 160/1; 49/26

[58] Field of Search ..... 405/103, 104; 160/1, 8; 49/26, 27, 28, 31, 141

[56] References Cited

U.S. PATENT DOCUMENTS

| | | | |
|---|---|---|---|
| 3,237,915 | 3/1966 | Palmer et al. | 405/104 X |
| 3,354,655 | 11/1967 | Armond | 405/104 X |
| 4,115,952 | 9/1978 | French | 49/26 |
| 4,273,974 | 6/1981 | Miller | 49/27 X |
| 4,365,188 | 12/1982 | Walter | 49/27 X |
| 4,458,445 | 7/1984 | Sauer et al. | 49/26 |
| 4,771,505 | 9/1988 | Dilich | 160/201 X |
| 5,203,110 | 4/1993 | Hormann | 49/28 |
| 5,228,492 | 7/1993 | Jou | 49/26 X |
| 5,384,982 | 1/1995 | Galperin | 49/27 |

FOREIGN PATENT DOCUMENTS 404166591 6/1992 Japan .

*Primary Examiner*—Tamara L. Graysay
*Assistant Examiner*—Jong-Suk Lee
*Attorney, Agent, or Firm*—Malloy & Malloy, P.A.

[57] ABSTRACT

A flood gate structure incorporating a safety device thereon to prevent harm through crushing or trapping of animals, such as manatees by the flood gate when passing into its closed position. An object sensor, along with an override sensor assembly, are provided and coupled to the flood gate and are positioned to open or close a circuit associated with the object and override sensor assemblies thereby regulating current flow to a drive motor which is drivingly attached to the flood gate and, upon activation thereof, serves to move the flood gate between its open and closed position. Contact of the object sensor with an animal or any other object located in interruptive relation to the flood gate, while closing, will serve to open the aforementioned circuit and prevent continued closure or affect re-opening of the flood gate until the animal or object is removed, while contact of the override sensor with an underlying support surface serves to permit complete closure of the gate despite engagement of the object sensor with the underlying support surface.

18 Claims, 4 Drawing Sheets

FLOOD CONTROL GATE SAFETY DEVICE

BACKGROUND OF THE INVENTION

1. Field of the Invention

The present invention is directed towards a flood gate to control the flow of water through a passage and along a waterway wherein a safety device is incorporated for use with the flood gate in order to prevent the inadvertent trapping or crushing of animals or any other object within the passage and beneath the flood gate while the flood gate is passing from its normally open position to its closed position.

2. Description of the Related Art

The use of flood gate structures in controlling flow of water along existing waterways, is quite common and well-known in the prior art. Typically, the use of such flood gate structures is crucial for proper water management in areas where numerous, interconnecting waterways exist. In addition, the use of these flood gate structures may efficiently regulate the level of water in certain areas where, for example, heavy rainfall is prevalent and/or rainstorms frequently occur. By draining such heavily rained upon areas, the flooding of surrounding land areas adjacent to the aforementioned waterways may be prevented or reduced.

For example, in the state of Florida heavy rainfall and storms are prevalent during certain summer months of the year. In order to prevent flooding of the rained upon areas, flood gates of the type generally described above are utilized so that such areas and more specifically the canals or like waterways in such areas may be drained to reduce the level of water contained therein. Flooding is thereby prevented and the collected water in such canals can be safely and efficiently directed to other land areas which may need such additional water. The water may also be drained directly into the ocean for disposal.

One problem associated with the operation of such flood gate structures, especially in South Florida, is the inadvertent crushing, trapping and subsequent drowning of or harm to certain animals which naturally inhabit the canals and like waterways throughout that area of the state. One such animal is the endangered manatee or "sea cow" which is generally considered to be a slow moving, docile animal traveling submerged, beneath the surface of canals and like waterways. Such animals are in fact air-breathing mammals but they have the capacity to stay submerged for long periods of time. It is not uncommon for the manatee to rest or otherwise maintain a position generally adjacent or within a passage in which a flood gate operates. As is common, the flood gate typically will be raised to an open position to allow free flow of water through the passage. Flow water is selectively restricted by lowering or closing the flood gate. This serves to block or significantly restrict water flow through that passage. It should be readily apparent that if an air-breathing mammal, such as the manatee, is located within the passage and below the flood gate as it is being lowered into its closed position, harm can result from the continued travel of the gate. If the manatee is not killed by crushing, it is sometimes trapped below the surface of the water thereby resulting in a drowning of the animal.

Based on the above, it is apparent that there is a recognized need in this area for some type of safety device which can readily detect an object or an animal within a passage and in interruptive relation to the path of travel of a flood gate as it is passing from its open position into its closed position. Preferred safety devices associated with this type of flood gate should be efficient in sensing an animal or object located in the path of travel of the flood gate without actually harming or damaging the animal so positioned. Further, such a preferred safety device or assembly should not interfere with the normal operation with the flood gate and its selective or automatic positioning between an open position and a closed position. The operation of such a preferred safety device should be such as to automatically stop travel of the flood gate into its fully closed position and allow the release or removal of the animal after it has been detected and subsequent to the stopping of the flood gate. Additionally, such a device should not be readily susceptible to malfunction as a result of the submerged nature of the flood gate, or should the surrounding water be murky or otherwise have minimal visibility.

SUMMARY OF THE INVENTION

The present invention relates to a flood gate structure incorporating a safety device or assembly thereon which prevents the inadvertent trapping or crushing of a submerged animal or object while the subject flood gate is traveling from its open to its closed position. More specifically, the present invention includes a gate which is disposed to move in a substantially vertical path of travel between a raised or open position and a lowered or closed position. In the raised or open position, the flood gate is disposed to allow free flow of water through the passage and along a canal or like waterway. To the contrary, when the gate is in its lowered or completely closed position, flow of water through the passage in which the gate assembly is mounted is blocked or severely restricted. Selective or automatic positioning may occur through operation of preferably an electrically powered drive motor. The drive motor may be secured in driving connection or engagement to the gate by any type of connecting structure such as a cable, drive shaft, etc. Flow of electrical current to the motor will cause its activation thereby serving to either raise or lower the gate.

A feature of the present invention is the existence of a safety assembly used in combination with and mounted on the gate so as to effectively travel therewith. More specifically, the subject safety assembly includes an object sensor and an override sensor. Both of these sensors are preferably mounted at least partially on the gate so as to move therewith, but are further connected to the gate so as to be capable of movement relative thereto when necessary.

The subject safety assembly further includes a circuit assembly serving to interconnect the drive motor to any type of conventional electrical power source. The circuit means includes a plurality of switch structures which are associated with both the object sensor and the override sensor. Each of the plurality of switch structures includes a pair of contacts positionable into and out of engagement with one another so as to define either a closed circuit position or an open circuit position.

For example, a first and second override contact are associated with the override sensor. Depending upon the position of the gate between its open and closed position, the override sensor will be disposed such that the first and second override contacts are either into or out of engagement with one another. Similarly, each of the one or more switch structures associated with the object sensor will be defined by a first and second sensor contact. Depending upon the position of the object sensor relative to the gate and the position of the gate between its open and closed position, the sensor contacts of the object sensor structure will be in either an open or closed circuit position. Generally speaking, when the gate is in its open position or travelling from its closed to its open position, the object sensor is disposed relative to the gate so that the first and second object contacts are engaging one another thereby defining a closed circuit position and allowing current to flow to the drive motor. In this same position, however, the override sensors are disposed relative to the gate such that the contacts associated therewith are maintained in an open position.

However, upon a closing of the gate, the first and second contact associated with the object sensor are forced out of engagement with one another. Concurrently, the first and second contacts associated with the override sensor are forced into engagement with one another thereby maintaining a closed circuit position of the circuit assembly and allowing continued current flow from the aforementioned electrical power source to the drive motor.

In the event that an object or animal is sensed by the object sensor as the gate travels from its open position towards but not yet into its completely closed position, the overall position of the object sensor, or at least a portion thereof, will be such as to separate the first and second object contacts associated with the object sensor. When such an event occurs, all of the contacts associated with the switch structures of both the override sensors and the object sensors will become disengaged. An open circuit position of the circuit assembly is thereby maintained and current flow to the drive motor is prevented. The travel or movement of the flood gate into its closed position will immediately stop and possibly reverse, so that the animal or object may remove itself or be removed from its potentially trapped position beneath the gate.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

The present invention, as shown in FIGS. 1–9, is directed towards a flood gate assembly generally indicated as 10. The flood gate assembly 10 is designed to regulate flow of water through a passage 12 in which the flood gate assembly 10 is mounted. The passage 12 is disposed within a canal or like waterway and is sufficiently dimensioned so as to allow adequate water to flow therethrough, along the waterway, when desired.

Figure 2:
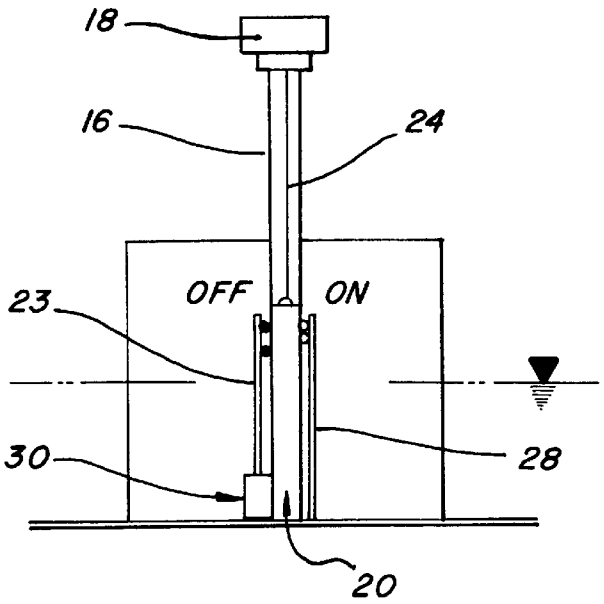
FIG. 2 is a side view of the embodiment of FIG. 1.
Figure 1:
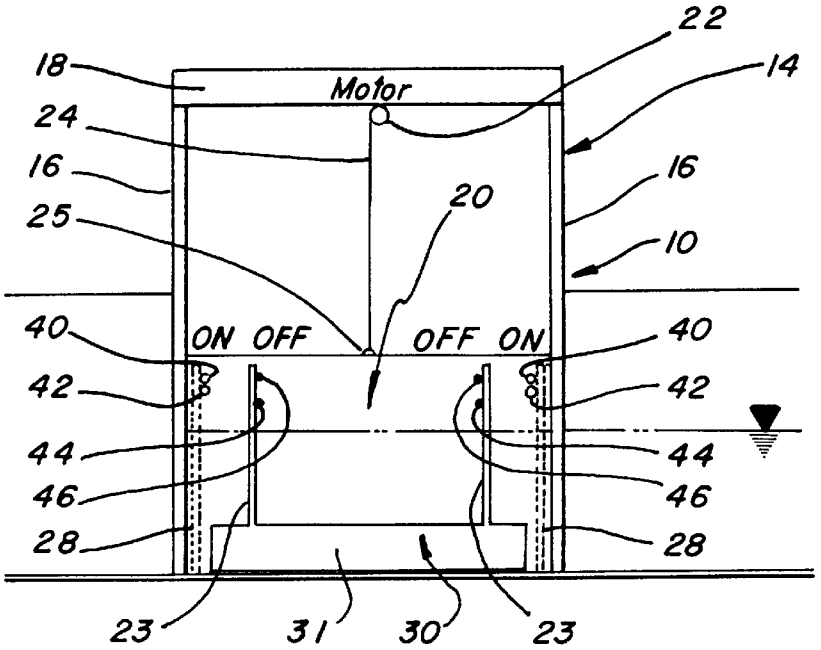
FIG. 1 is a front view of a preferred embodiment of the present invention.
Figure 4:
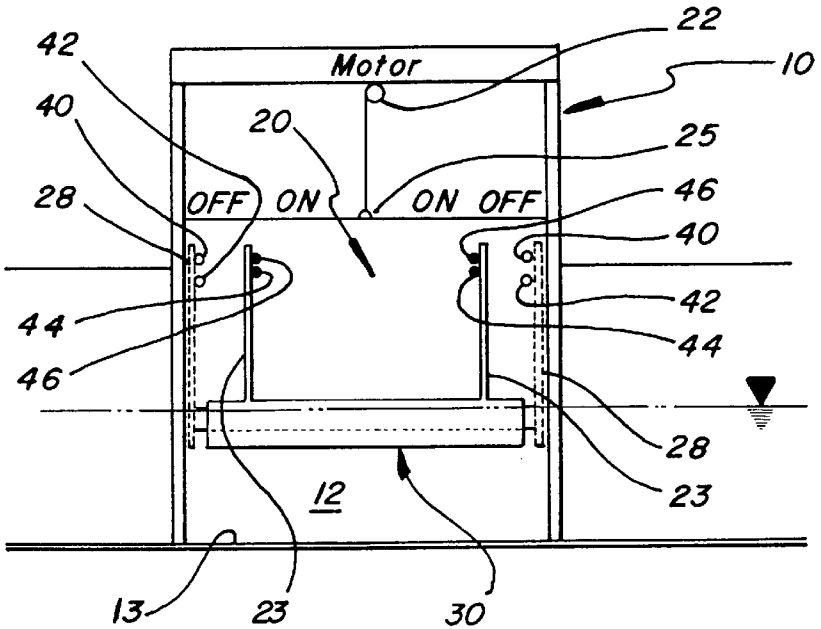
FIG. 4 is a front view of the embodiment of FIG. 1 in a different position.

The subject flood gate assembly 10 includes a support or foundation assembly generally indicated as 14. This support assembly 14 may take any of a variety of configurations, but is dimensioned and configured to movably position or dispose a gate 20 into an open or closed position relative to the water flowing through the passage 12. In the embodiment shown in the accompanying figures, the support assembly 14 includes a plurality of upstanding stanchions 16, which may define a track or guide way therein, and possibly a cross or support brace as at 18 so as to stabilize the support assembly 14 during movement of the gate. By virtue of this structure, gate 20 is capable of being selectively moved between its closed position, as shown in FIG. 1 wherein water flow through the passage 12 is substantially restricted and/or regulated, and its open position, as generally shown in FIG. 4 wherein the free flow of water is achieved. Moreover, preferably,the gate 20 is of a substantially strong, solid, planar configuration so as to withstand a substantial amount of water pressure for an extended period of time when in the closed position.

The movement of the gate 20 may be automatic, such as on a timer or water level monitor, or selective and possibly occurs through activation of a drive motor as at 22. The drive motor 22 is preferably electrically powered from a conventional electrical power source (not shown for purposes of clarity). The drive motor 22 is attached in driving relation to the gate 20 in a conventional fashion, such as by some type of connecting structure 24. This connecting structure 24 may be in the form of an elongated cable or some type of drive or push rod, wherein the connecting structure 24 is connected substantially at one end to the gate 20, as at 25, and is drivingly attached in some effective manner to the drive motor 22. Activation through continuous current flow to the drive motor 22 will cause positioning of the gate 20 between the aforementioned open and closed positions, as shown throughout the drawings.

The flood gate assembly 10 of the present invention further includes a safety assembly. Moreover, the safety assembly preferably includes a sensor assembly comprising an override sensor structure and an object sensor structure. Specifically, the object sensor includes a buffer structure or element as at 30 disposed generally adjacent the lower periphery of the gate 20. The buffer assembly 30 is preferably coupled to the gate 20 in such a manner as to move therewith as well as relative thereto. In particular, the buffer assembly 30 is structured to move up and down with the gate unless it encounters resistance, such as from an obstacle or underlying support surface, after which it moves relative to the gate 20. Preferably, the buffer assembly 30 is structured to move relative to the gate 20 under only slight amounts of resistance, however, its construction is preferably such that it will not tend to float or be resisted by the water flow itself and will preferably maintain its position by gravity. Also, in the embodiment shown, at least one, but preferably a pair of connecting rods 23 extend from the buffer assembly 30 and are movably coupled to the gate 20 in order to effectuate movable coupling of the buffer assembly 30 in the aforementioned fashion. In the preferred embodiment, the connecting rods 23 may ride within a track or bracket so as to achieve free vertical movement relative to the gate 20, while permitting the normal weight of the buffer assembly 30 to maintain the buffer assembly in a lowered, detecting position.

Looking to the override sensor, in the preferred embodiment, the override sensor structure includes at least one, but preferably a pair of spaced apart, elongated sensor members 28. Each of the sensor members 28 are coupled to the gate 20 so as to move therewith, but also in a manner which allows movement thereof relative to the gate 20. Much like the connecting rods 23 of the object sensor, the sensor members 28 preferably move freely relative to the gate 20, such as within a track or bracket assembly, however, the weight thereof ensures that a lower portion protrudes from beneath the gate until it engages an underlying support surface 13.

Figure 3:
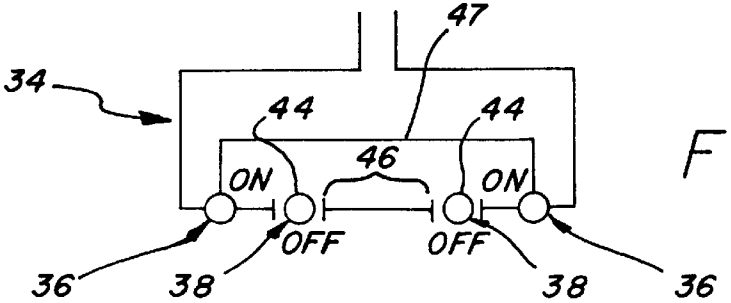
FIG. 3 is a schematic representation of a circuit assembly associated with the preferred embodiment of the present invention.
Figure 5:
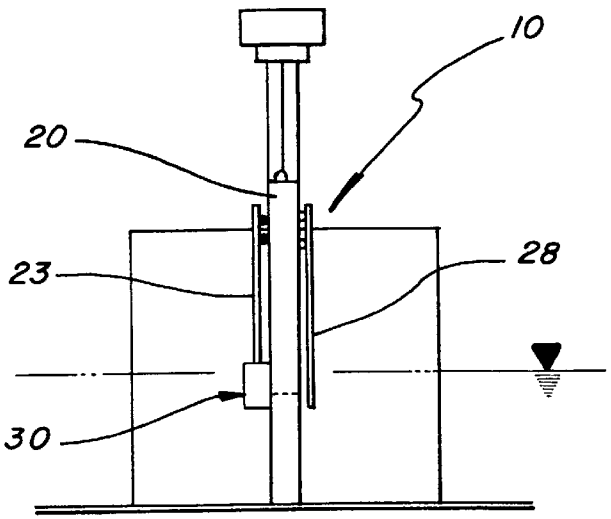
FIG. 5 is a side view of the embodiment of FIG. 4.
Figure 6:
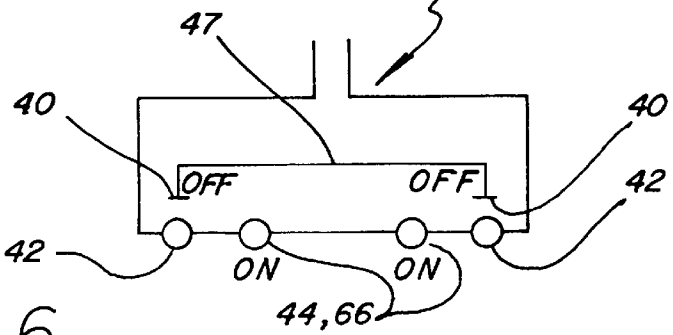
FIG. 6 is a schematic representation of the circuitry assembly associated with the position of the structure of FIG. 4.
Figure 9:
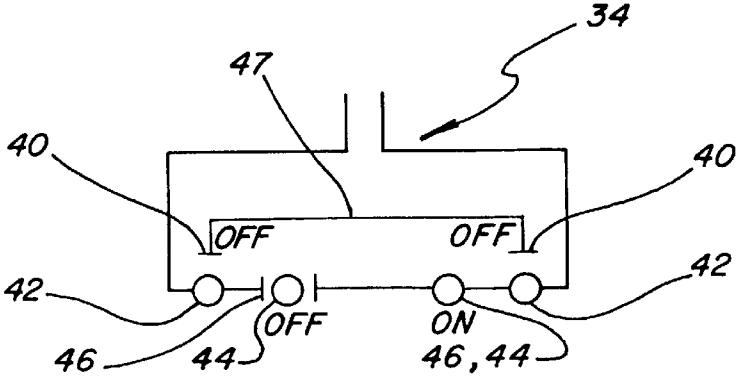
FIG. 9 is a schematic representation of the circuitry associated with the position of the structure of FIG. 7.
Figure 10:
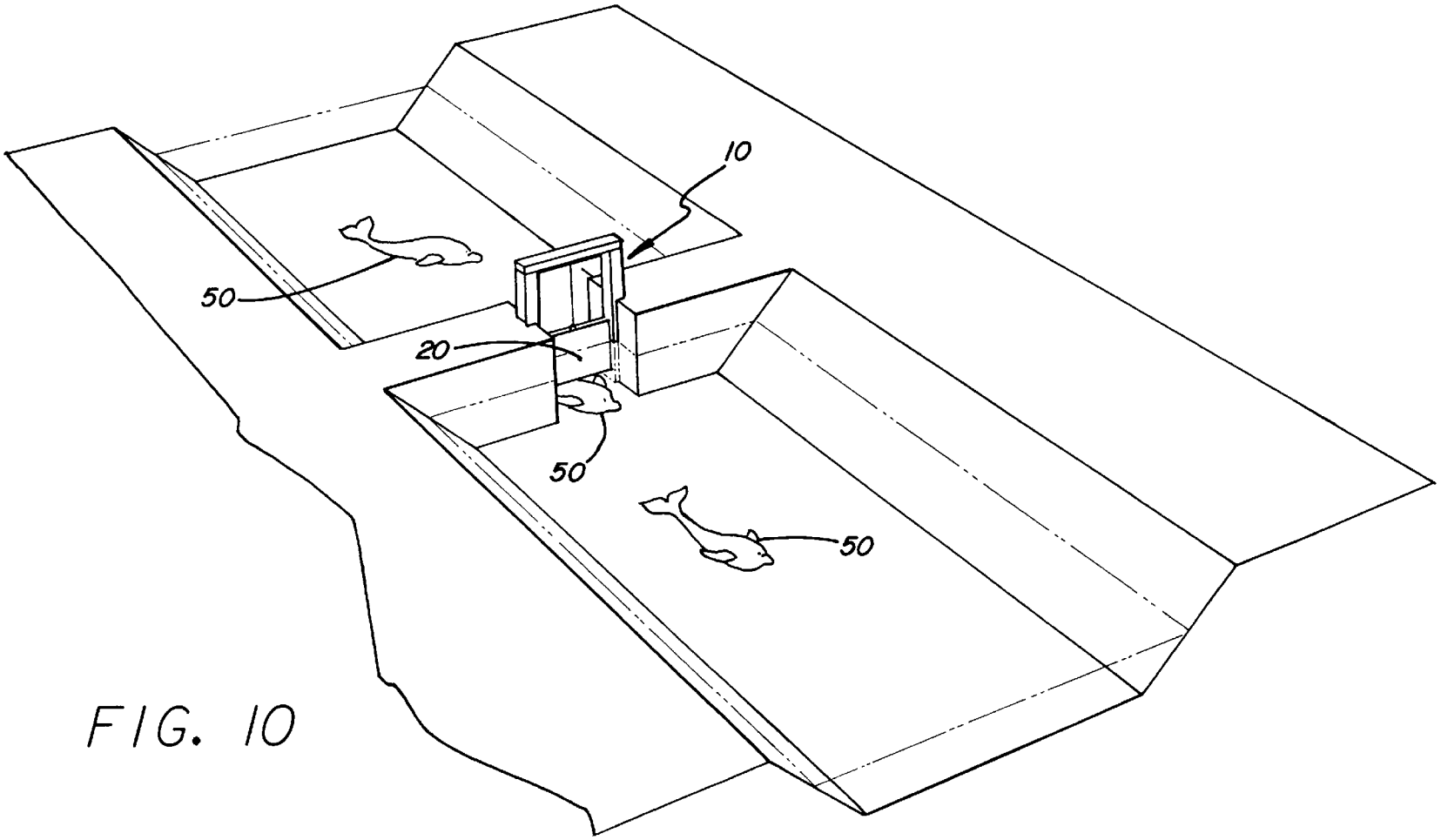
FIG. 10 is an elevated perspective view of the preferred embodiment of the present invention.

The safety assembly of the present invention further comprises a circuit means represented schematically, at least in part, in FIGS. 3, 6 and 9. The circuit assembly generally indicated as 34 comprises a plurality of switch structures generally indicated in FIG. 3 as 36 and 38. The switch structures 36 are associated directly with and coupled to the override sensor, and correspondingly the switch structures 38 are associated with the object sensor, as described hereinafter in greater detail.

Each of the switch structures 36 and 38 preferably includes a plurality of contacts movably disposed relative to one another. Specifically, the switch structure 36 preferably includes at least one, but preferably a pair of first override contacts 40 mounted on and movable with the gate 20, and a second override contact 42 secured to and movable with each of the sensor members 28. Additionally, switch structures 38, which are associated with the object sensor, include at least one, but preferably a pair of first sensor contacts 44 mounted on and movable with the gate 20 and a second sensor contact 46 mounted on and movable preferably with the connecting members 23 of the object sensor. From the aforementioned disposition and as will be explained in greater detail hereinafter, movement of the gate between a closed and opened position will cause respective movements of the contacts 40 and 42 associated with the override sensor, as well as contacts 44 and 46 associated with the object sensor.

In operation, current flow to the driving motor 22 occurs when the circuit assembly 34 assumes a closed position. Such a closed-current flowing position can occur by all or some of the override contacts 40 and 42 of the plurality of switch structures 36 associated therewith being in engagement with one another. When this occurs, the current flows through a secondary conductor as at 47. Alternately, current flows from an electrical power source (not shown) to the drive motor 22 to allow its continued activation when the first and second override contacts 40 and 42 are out of engagement with another, but yet a closed circuit position is still defined by the engaging, closed position of the first and second sensor contacts 44 and 46 (see FIGS. 4 and 6) associated with the object sensor. The relative dispositions of the switch structures associated with both the override sensors and the object sensor is such that at all times during normal travel and positioning of the gate 20 either the first and second contacts 40 and 42 of the override sensors are in closed engagement or the first and second contacts 44 and 46 of the object sensor are in closed engagement. Either situation will define the aforementioned closed circuit condition allowing current to flow to the drive motor 22. For example, as the gate 20 is lowered, the buffer assembly 30 remains down and the first and second sensor contacts 44 and 46 associated therewith remain engaged. As, however, the buffer assembly 30 engages the underlying support structure and is displaced a sufficient amount to disengage the first and second sensor contacts 44 and 46, the exposed lower portion of the sensor members 28 of the override sensor engage the underlying support surface 13 to achieve a contact at the first and second override sensor contacts 40 and 42. Of course, the gate travel distance between disengagement of the object sensor and engagement of the override sensor will be sufficiently small such that an object cannot be trapped between the gate 20 and the underlying support surface 13 at that time.

Figure 8:
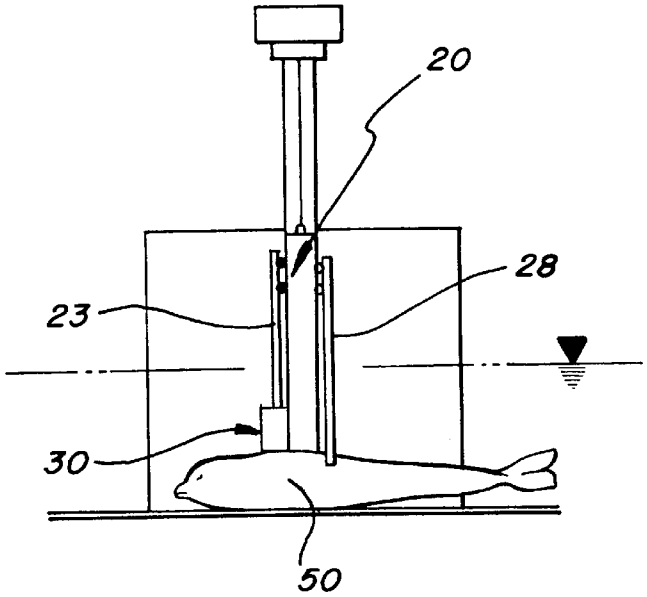
FIG. 8 is a side view of the embodiment of FIG. 7.
Figure 7:
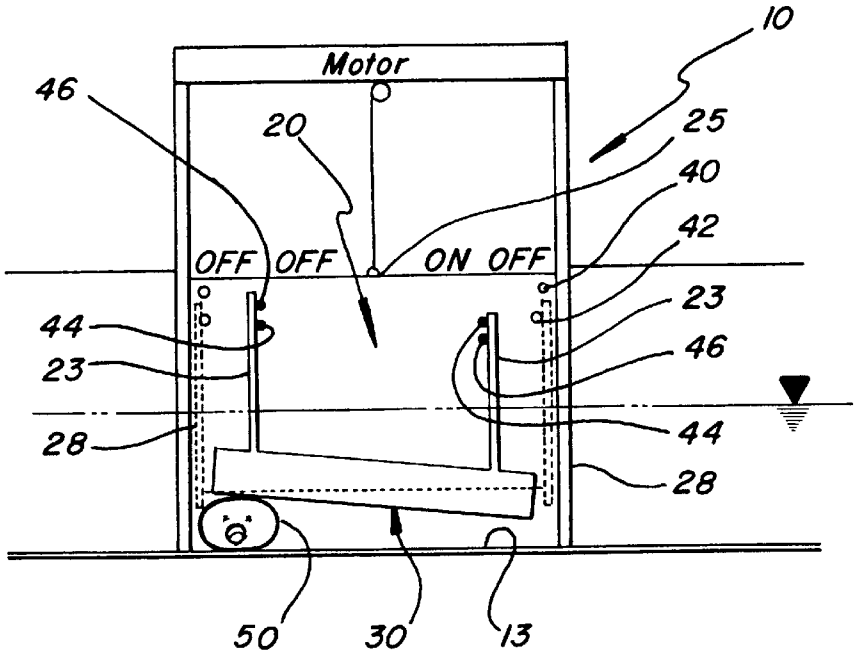
FIG. 7 is a front view of the embodiments of FIG. 4 in yet a different position.

With reference to FIGS. 7 and 8, the safety device preferably includes an elongated buffer structure 31 which defines one possible structure of a buffer assembly 30. The buffer structure 31 may be pivotally or otherwise movably mounted such that an engagement of one end or generally any part thereof will cause an upward displacement of one or more of the connecting members 23. Moreover, the buffer structure 31 is such that displacement thereof will cause a disengagement of the respective sensor contacts 44 and 46, as shown in FIGS. 7 and 9. Indeed, the location of a trapped animal 50 will be immediately sensed by the contact of the buffer structure 31 with the animal or object 50. specifically, immediately prior to such sensing engagement, the circuit will be in its closed circuit position due to the engagement of the first and second contacts 44 and 46 of the switch structure associated with the object sensor. However, upon engagement of the buffer structure 31 with the animal or object as at 50, disengagement of at least one of the first and second contact pairs of one of the plurality of switch assemblies associated with the object sensor (See FIGS. 7 and 9) will occur thereby defining an open circuit position. This open circuit position will prohibit current flow to the activating motor 22 thereby immediately stopping the downward travel into its fully closed position and possibly reversing the direction of travel. The animal or object 50 will be saved from harm or damage and should be able to escape or be removed. Further protection of the animal or object 50 can be assured by the buffer structure 31 including a bumper element formed from some type of soft, resilient material which will not cause abrasions or other physical damage. Once the animal 50 removes itself or is removed, the gate 20 will be allowed to assume its fully closed position and the engagement of the bumper element 31 with the underlying support surface 13 will cause a disengagement of the first and second sensor contacts 44 and 46, but the overall downward travel of the gate 20 will force a concurrent engagement of the first and second override contacts 40 and 42, as previously described. In the position of the gate 20 shown in FIG. 1, the gate 20 is in its fully closed position and the closed circuit position is defined by the engagement of the first and second contacts 40 and 42 of the override sensor.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A flood gate assembly designed to regulate water flow along a waterway and through a passage, said assembly comprising:

a) a support structure mounted adjacent the passage, b) a gate movably mounted on said support structure, said gate movable between an open position and a closed position relative to the passage, c) a drive assembly structured to selectively move said gate between said open and closed positions, d) a safety assembly mounted on said gate and disposed and configured to prevent said gate from moving into said closed position when an object is disposed substantially within the passage and in interruptive relation to movement of the gate, e) said safety assembly including a sensor assembly coupled to said gate and structured to be movable therewith and relative thereto, and f) said sensor assembly including an object sensor structured and disposed relative to said gate and the passage to engage and be actuated by the objects disposed substantially within the passage and in interruptive relation to a path of travel of said gate into said closed position, whereby actuation of said object sensor by the objects disposed substantially within the passage and in interruptive relation to said path of travel of said gate into said closed position stops movement of said gate into said closed position, g) said sensor assembly further including an override sensor, h) said safety assembly further comprising a circuit assembly including a plurality of switch structures coupled to said sensor assembly and said gate i) said plurality of switch structures each including a circuit open and a circuit closed position, and comprising first and second override contacts respectively coupled to said override sensor and said gate and being movable relative to one another and disposed to at least partially define said circuit closed position when said gate is in said closed position.

j) said object sensor including a buffer assembly movably mounted on said gate and positionable between said circuit open and said circuit closed positions, said circuit closed position defined by said buffer assembly depending below a lower periphery of said gate.

2. The assembly as recited in claim 1 wherein said drive assembly includes a drive motor coupled in driving relation to said gate, whereby activation of said drive motor causes movement of said gate between said open position and said closed position.

3. The assembly as recited in claim 2 wherein said switch structures are structured to regulate current flow through said circuit assembly and accordingly between a power source and said drive motor.

4. The assembly as recited in claim 3 wherein said object sensor and said override sensor are movable relative to said gate between said circuit open and said circuit closed position so as to correspondingly position said plurality of switch structures between said circuit open and said circuit closed position.

5. The assembly as recited in claim 4 wherein said plurality of switch structures are cooperatively disposed relative to one another to interrupt current flow through said circuit assembly upon said object sensor contacting the object within the path of travel.

6. The assembly as recited in claim 1 wherein said buffer assembly comprises an elongated bumper element of sufficient length to extend along at least a majority of the lower periphery of said gate and movably disposed to extend downwardly from said lower periphery, when said object sensor is in said circuit closed position.

7. The assembly as recited in claim 1 wherein said override sensor comprises at least one sensor member movably mounted on said gate and disposable between said circuit open and said circuit closed position, said circuit open position defined by a lower portion of said sensor member extending below said lower periphery in spaced relation to said buffer assembly and in engageable relation with a bottom of the passage.

8. The assembly as recited in claim 7 wherein said plurality of switch structures include said first override contact mounted on said gate and movable therewith and said second override contact mounted on said sensor member and movable therewith, said first and said second override contacts being movable relative one another and relatively disposed to at least partially define said circuit closed position when said gate is in said closed position.

9. The assembly as recited in claim 8 wherein said plurality of switch structures include a first sensor contact coupled to said buffer assembly and movable therewith, and a second sensor contact mounted on said gate and movable therewith, said first and second sensor contacts being movable relative to one another and being relatively disposed to at least partially define said circuit closed position when said gate is in said open position.

10. The assembly as recited in claim 9 wherein said buffer assembly is disposed and structured to move relative to said gate and position said first and second sensor contacts in said open circuit position upon engaging an object within the passage when said gate is in said open position, whereby said gate is prevented from traveling into said closed position.

11. The assembly as recited in claim 1 wherein said first and second override contacts are respectively movable with said override sensor and said gate, and are relatively disposed for positioning into said circuit open position when said gate is in said open position.

12. The assembly as recited in claim 1 wherein said plurality of switch structures comprise first and second sensor contacts respectively coupled to said buffer assembly and said gate and being movable relative one another to at least partially define said circuit closed position when said gate is in said open position.

13. The assembly as recited in claim 12 wherein said first and said second sensor contacts are respectively movable with said buffer assembly and said gate and are relatively disposed for positioning into said circuit open position when said gate is in said closed position.

14. The assembly as in claim 12 wherein said buffer assembly is disposed and structured to move relative to said gate and position said first and second sensor contacts in said open circuit position upon engaging an object within the passage when said gate is in the open position, whereby said gate is prevented from traveling into said close position.

15. The assembly as recited in claim 14 wherein said first and second override contacts are respectively movable with said override sensor and said gate and relatively disposed for positioning into said circuit open position when said gate is in said open position.

16. The assembly as recited in claim 12 wherein said circuit assembly is normally maintained in said closed circuit position by engagement of said first and second override contacts when said gate is in said closed position and by engagement of said first and second sensor contacts when said gate is in said open position.

17. The assembly as recited in claim 16 wherein said first and second override contacts are positioned in engaging relation to one another and disposed relative to spaced apart ones of said first and second sensor contacts to define said circuit closed position independent of said first and second sensor contacts when said gate is in said closed position.

18. A flood gate assembly designed to regulate water flow along a waterway and through a passage, said assembly comprising:

a) a support structure mounted adjacent the passage, b) a gate movably mounted on said support structure, said gate movable between an open position and a closed position relative to the passage, c) a drive assembly structured to selectively move said gate between said open and closed positions, d) a safety assembly mounted on said gate and disposed and configured to prevent said gate from moving into said closed position when an object is disposed substantially within the passage and in interruptive relation to movement of the gate, e) said safety assembly including a sensor assembly coupled to said gate and structured to be movable therewith and relative thereto, and f) said sensor assembly including an object sensor structured and disposed relative to said gate and the passage to engage and be actuated by the objects disposed substantially within the passage and in interruptive relation to a path of travel of said gate into said closed position, whereby actuation of said object sensor by the objects disposed substantially within the passage and in interruptive relation to said path of travel of said gate into said closed position stops movement of said gate into said closed position, g) said safety assembly including a circuit assembly having a circuit open and circuit closed position, h) said object sensor including a buffer assembly movably mounted on said gate and positionable between said circuit open and said circuit closed positions, said circuit closed position defined by said buffer assembly depending below a lower periphery of said gate, and i) said sensor assembly further comprising an override sensor including at least one sensor member movably mounted on said gate and disposable between said circuit open and said circuit closed position, said circuit open position defined by a lower portion of said sensor member extending below said lower periphery in spaced relation to said buffer assembly and in engageable relation with a bottom of the passage.

* * * * *